US006604472B2

(12) United States Patent
McNeil

(10) Patent No.: US 6,604,472 B2
(45) Date of Patent: Aug. 12, 2003

(54) LAPTOP COMPUTER SUPPORT TABLE

(76) Inventor: William S. McNeil, 10109 Raleigh-LaGrange Rd., Eads, TN (US) 38028

( * ) Notice: Subject to any disclaimer, the term of this patent is extended or adjusted under 35 U.S.C. 154(b) by 0 days.

(21) Appl. No.: 09/866,620

(22) Filed: May 30, 2001

(65) Prior Publication Data

US 2002/0178972 A1 Dec. 5, 2002

(51) Int. Cl.[7] ..... A47B 23/00
(52) U.S. Cl. ..... 108/42; 108/152
(58) Field of Search ..... 108/42, 152, 48; 248/161, 157; 190/11, 12 A, 15.1

(56) References Cited

U.S. PATENT DOCUMENTS 2,304,705 A * 12/1942 Pate
3,083,053 A * 3/1963 Dorsey
5,127,339 A * 7/1992 Hood, Jr.
5,156,096 A * 10/1992 Lamprey
5,528,993 A * 6/1996 Vincelli
5,639,109 A * 6/1997 Liang
5,983,912 A * 11/1999 Leu
6,105,508 A * 8/2000 Ryburg
6,237,734 B1 * 5/2001 Chen
6,240,857 B1 * 6/2001 Elizer

FOREIGN PATENT DOCUMENTS

FR 2796816 * 2/2001

* cited by examiner

*Primary Examiner*—Jose V. Chen
(74) *Attorney, Agent, or Firm*—Ronald E. Greigg

(57) ABSTRACT

A pair of embodiments are disclosed for providing a computer table attachable to a piece of luggage standing in an upright position upon which a portable computer may be supported for typing use. One embodiment provides a simple, flat, custom-designed piece of ABS plastic with a foldable leaf portion adapted to be received in a cavity in the flat plastic tray. The leaf portion has trunnions adjacent one end which are adapted to be received into complemental slots to allow the leaf to fold away. In this embodiment the tray has a reduced overall thickness than in the second embodiment. In the second embodiment the tray is fitted with a fixed upstanding rib member rather than one which may be folded away. In both embodiments a further but shorter rib is provided at the opposite end of the tray to insure that a computer does not slide off the tray while the tray is in use. Another slight rib could extend about the periphery of the table.

8 Claims, 4 Drawing Sheets

LAPTOP COMPUTER SUPPORT TABLE

FIELD OF THE INVENTION

This invention is directed to improvements in supporting portable computers for use outside an office area where there is no table space available.

BACKGROUND OF THE INVENTION

The invention discloses a novel concept of enabling busy executives, lawyers, traveling salesmen, etc., and any other person who must travel extensively, to have a convenient manner of supporting their computer without trying to hold it on their lap.

Trying to sit and balance a laptop computer, some weighing in excess of 15 pounds, can become very uncomfortable over a short period of time. While balancing a laptop on your legs and trying to reach for papers, talk on the phone, or making any sudden movement, your laptop could fall off your lap and cause damage to the computer, loss of valuable information, or bodily injury. Once seated with your laptop on your legs, it becomes very difficult to move around without first finding a safe and convenient place to secure your laptop.

PRIOR ART RELATED TO THE INVENTION

A study of the prior art reveals a multitude of support trays, folding tables, etc. adapted for variable uses, yet none show a device so simple in design and adaptable to use as disclosed in this application. Representative patents include the following:

1. U.S. Pat. No. 5,893,331 which shows a tray for attachment to a beach chair via Velcro fasteners or clamps;
2. U.S. Pat. No. 5,445,266 which shows carrying case for a computer that when set up allows the computer screen to be supported at a correct angle for use;
3. U.S. Pat. No. 5,316,374 which shows a foldable foot rest which can be attached to a piece of luggage;
4. U.S. Pat. No. 4,412,604 which shows a suitcase having legs which fold out from the bottom portion of the bag for use in supporting the luggage in a table-like position;
5. European Patent application No. 0 050 728 shows a platform which can be arranged within a suitcase using a hook fitted into a specially formed groove and an external lug to support the platform for us;
6. British Patent No. 4666 which is for a foldable combined table and chair that becomes a piece of carry luggage when folded;
7. French Patent No. 2,689,734 which shows an easel-like attachment for a brief case which can be moved between a folded away position and an extended for use position;
8. German patent publication OS 2933595 which shows a seat hinged to the side of a piece of luggage and having a fold out leg support.

SUMMARY OF THE INVENTION

The invention discloses a pair of embodiments for providing a computer table attachable to a piece of luggage standing in an upright position upon which a portable computer may be supported for typing use.

In one embodiment there is revealed a simple flat custom-designed piece of ABS plastic with a foldable portion adapted to be received in a cavity in the flat plastic tray. In this embodiment the tray is thinner in overall thickness than in the second embodiment. In the second embodiment the tray is fitted with a fixed upstanding rib member rather than one which may be folded away. In both embodiments a further but shorter rib is provided at the opposite end of the tray to insure that a computer does not just slide off the tray while the tray is in use.

The tray is particularly useful with the type of luggage which many persons are purchasing today (generically known as roll-on luggage) for quickly moving from taxis to airports for travel to the airplane as well as to train stations. Substantially all of the luggage manufactured today has an extensible as well as retractable pull handle feature so that the luggage may be pulled to the departure point and placed in an overhead rack, thereby making it unnecessary to wait for it to be returned to the owner at their arrival point. The manufacturers of these pieces of luggage, which are also provided with rollers or small wheels, encase the luggage on its exterior with attractive coverings, all of which have one or more zippered pockets, any one of which is capable of encompassing the flat tray revealed and claimed hereinafter.

OBJECTS OF THE INVENTION

It is therefore the principle object of the present invention to provide a novel tray member particularly adaptable for use with laptop computers by the owners of wheeled drag-along luggage which is pulled by a handle.

It is another object of the present invention to provide such a temporary table that is light in weight and easily stowed in one's luggage.

It is yet another object of the present invention that the tray can be held in a position for use at close to an optimum position.

It is still another object of the present invention that the tray can be installed in a position for use easily.

It is yet another object of the present invention that the tray can hold a computer in a secure position for use that does not create undue risk of the computer being dropped.

Other objects and advantages will become obvious to those skilled in the art upon a review of the drawings, specification and claims.

DESCRIPTION OF THE PREFERRED EMBODIMENTS

With reference to the drawings, the computer support member or tray 10 is, provided with a circumferential upstanding ridge of adequate height to prevent inadvertent slippage of the computer on the surface 10. At the present time, most laptop computers are not provided on the bottom area with a non-skid surface area so the upstanding rib will help prevent inadvertent slippage of the computer off of the tray laterally, which could seriously damage the computer being supported thereon.

Figure 4:
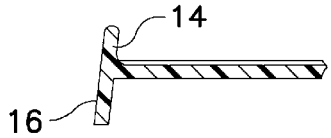
FIG. 4 is a detail view of the end of the tray opposite the first rib member showing the orientation of a second shorter rib member.

In a preferred embodiment the one end of the support member as shown in FIG. 4 may also include a lip 14 which is slightly taller than the circumferential ridge 12.

As shown in the drawings the laptop computer support is generally of a rectangular configuration and includes a means for projecting upwardly near the end opposite to the rib 14. This projection means can be one which is integrally molded in a fixed position into the laptop computer support member or it can be one which is movable between a stored position and a position for use.

In a preferred embodiment the tray is provided with an off-standing extension portion 16 which projects beyond the top wall of the support member. This extension portion 16 can be sized to fit more or less snugly between the pair of legs forming the extensible handles of the luggage and can be held in place by retracting the handle into an almost closed position. Alternatively, the extension portion 16 can be implanted between the sides of the carry handle of the luggage to be held in place by the loop of the handle.

In one embodiment the extension portion 16 includes, as does also the main body of the support member, a cavity or recess 18 surrounded by perpendicular walls 20 with the extension portion 16 provided in its width dimension with confronting oppositely disposed slots 22, 24 which slots are arranged to receive a leaf member 26 that is provided with a pair of ears or trunnions 28, 30 of adequate size to be snugly positioned in the slots 22, 24.

Figure 1:
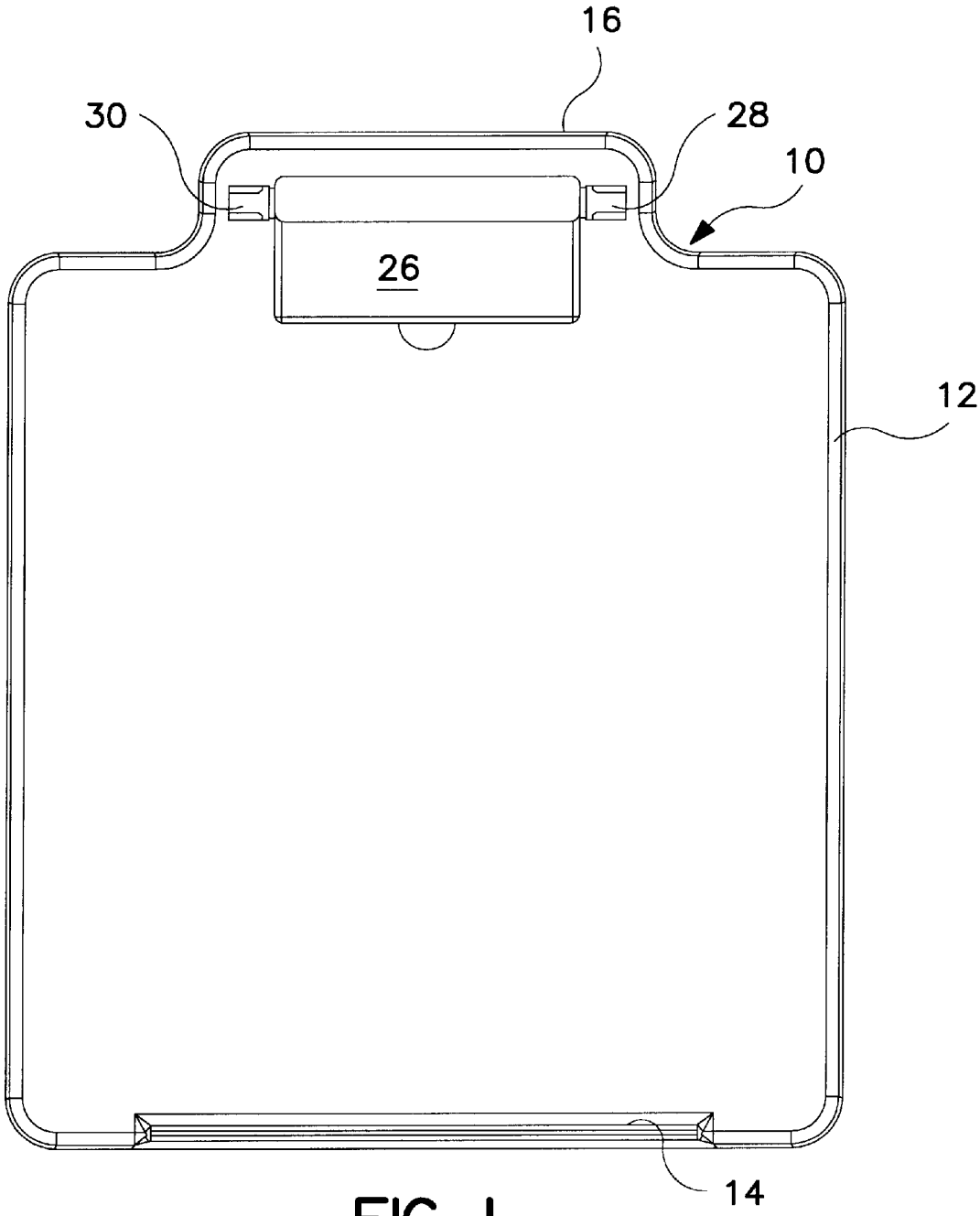
FIG. 1 is a plan view looking directly into the support surface for the laptop computer.
Figure 2:
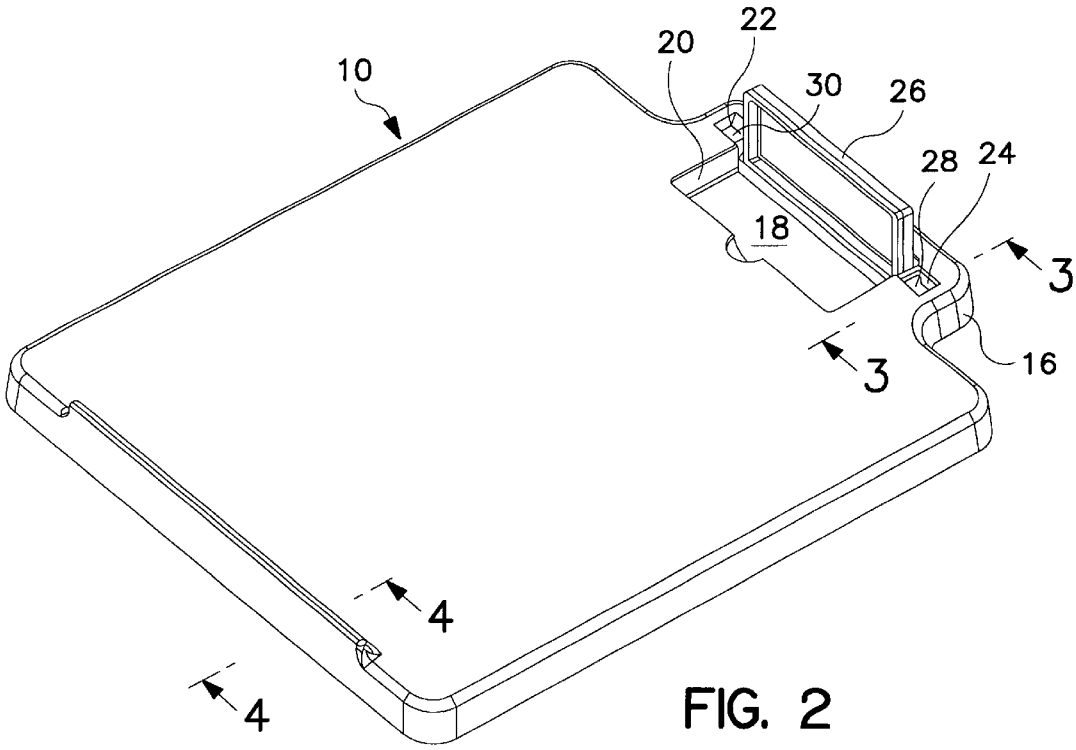
FIG. 2 is a perspective view of the laptop computer supporting member.
Figure 3:
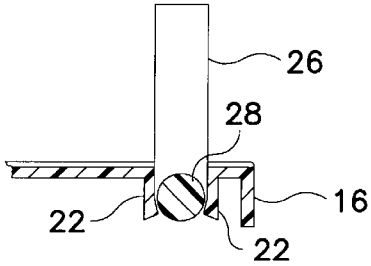
FIG. 3 is a cross sectional view through the foldable first rib member to show how it functions when in an upright position to support the computer.

With further reference to FIG. 3 it is pointed out that when the trunnions 28, 30 are inserted into the slots or apertures adapted to receive them, the slots are sized so as to grasp the trunnions firmly so that the leaf member 26 may be moved into an erect position where it will remain erect. The trunnions may also be provided with non-slip sleeves, the principal object being to retain the leaf member 26 into whatever position the user desires. Accordingly, it is to be understood that any variations of means to retain the flat panel erect is under the purview of this disclosure.

Figure 5:
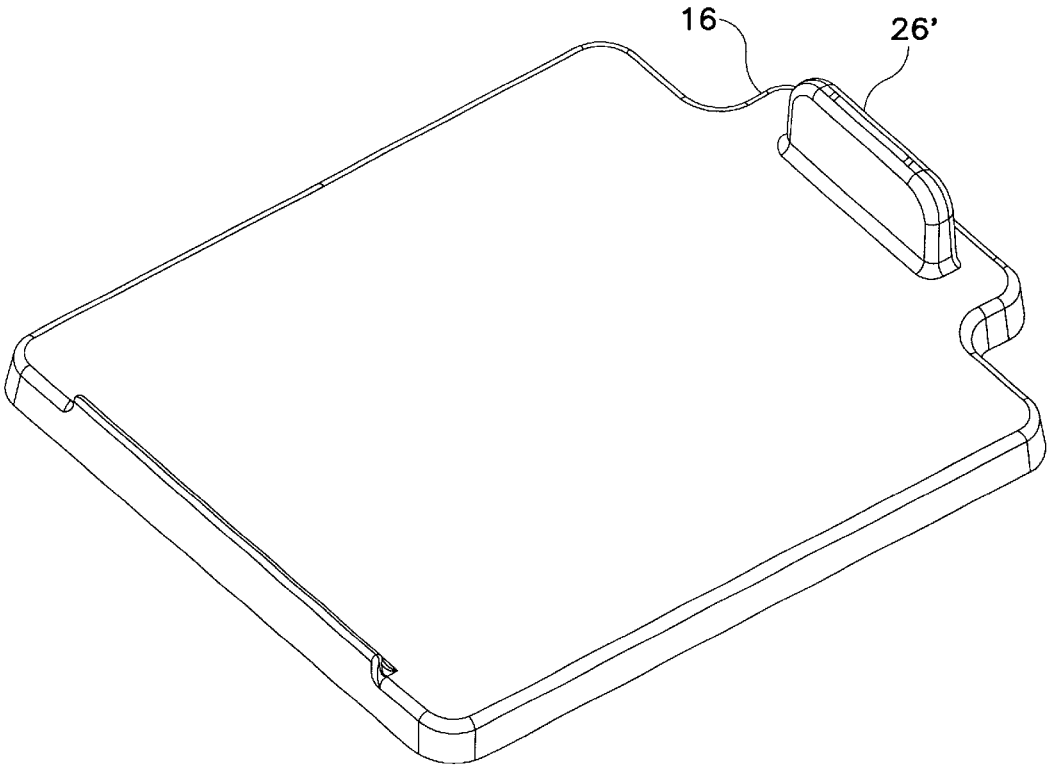
FIG. 5 is a showing of a second embodiment in which the erect member is integral with the tray.

FIG. 5 shows a second embodiment in which an erect member 26' is integral with the extension portion 16, and thus also with the rest of the computer support member.

Figure 6:
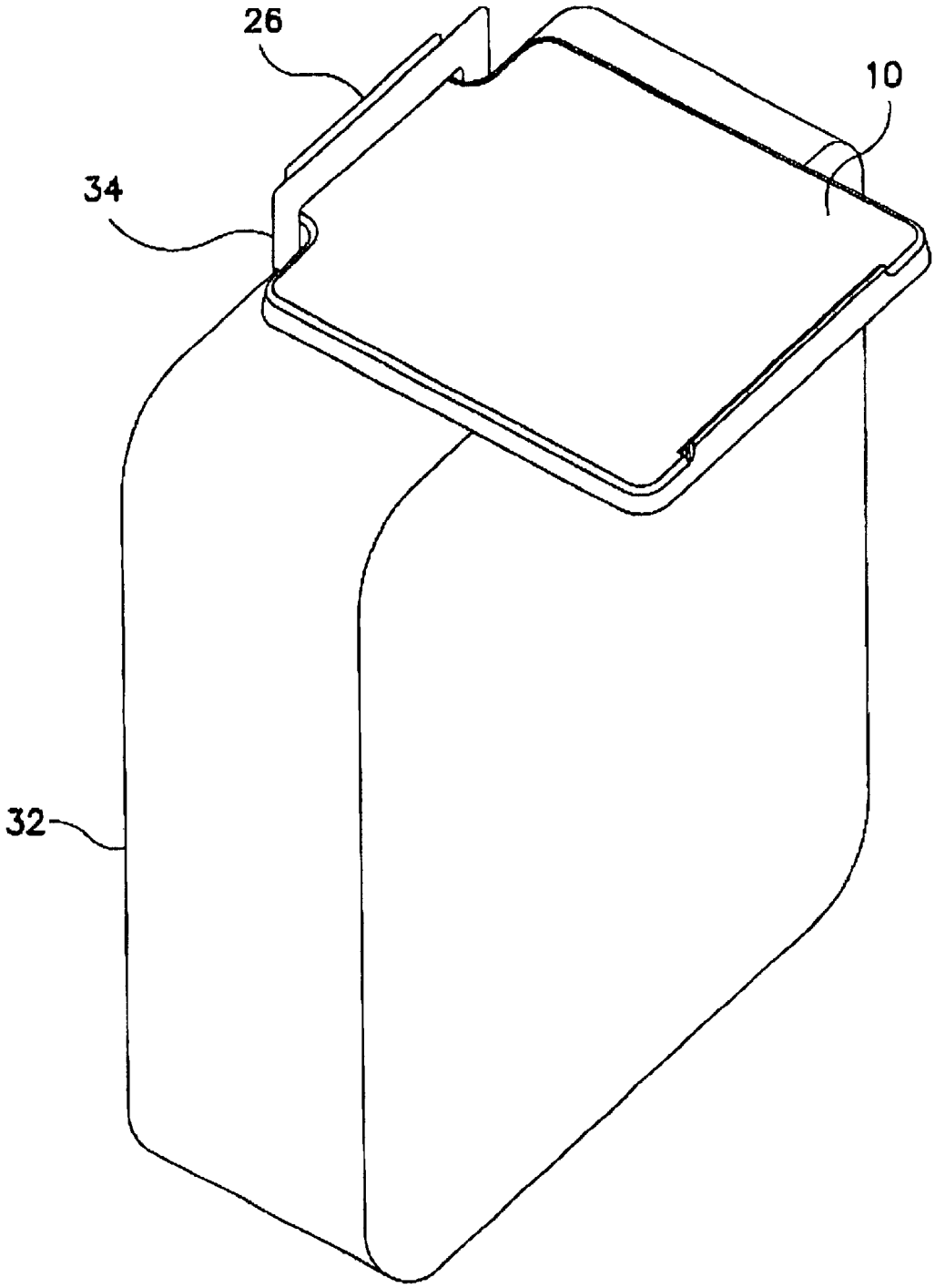
FIG. 6 is a showing of the support member in use on a piece of luggage.

FIG. 6 is a perspective showing of the computer support member 10 in place on a piece of luggage 32, with the erect member 26 hooked behind handle 34 of the luggage 32. As mentioned above, the handle 34 can be a retracting handle.

The foregoing description relates to preferred exemplary embodiments of the invention, it being understood that other variants and embodiments thereof are possible within the spirit and scope of the invention, the latter being defined by the appended claims.

I claim:

1. A laptop computer support member adapted for use with an adjustable handle of a piece of luggage, wherein the adjustable handle includes parallel dependent bars thereon which are telescopically arranged to be received in recesses provided in a top wall of said piece of luggage, said laptop computer support member comprising:

a tray element having a substantially planar top surface having an area adequate to accommodate and support a bottom surface of a laptop computer, said top surface of said computer support member further including a ridge adapted to retain the computer from sliding off the tray element when said computer support member is placed on the luggage, said support member further including a projecting portion bearing oppositely extending walls integral with said support member, which projecting portion is adapted to slip between the parallel dependent bars of the adjustable handle, said projecting portion being further provided with a recess arranged to receive a pivotally disposed leaf member capable of being moved out of the planar surface plane into an erect position after insertion between said parallel dependent bars, whereupon, when the adjustable handle is urged downwardly against the flat surface of the computer support member to secure the support member into a position for use as a table.

2. A laptop computer support member as claimed in claim 1, which further includes providing said pivotally disposed leaf member with laterally offstanding trunnion members adjacent to opposite edge portions thereof, said trunnion members arranged to be received in said slots in opposed wall areas of said recess in said portion which projects from said flat surface area.

3. A laptop computer support member as claimed in claim 2, wherein said leaf member is designed so as to be movable from a non-functional position from said planar surface into a right angular erect position when positioned beneath said adjustable handle.

4. A tray element which forms a support member for a laptop computer when positioned adjacent to and engaging an adjustable handle of a piece of luggage, wherein the adjustable handle includes front and back sides as well as parallel dependent bars thereon which are telescopically arranged to be received in recesses provided in a top wall of said piece of luggage, said tray element comprising:

a substantially planar top surface having an area adequate to accommodate and support a bottom surface of a laptop computer, said top surface of said tray element further including a ridge adapted to retain the computer from sliding off the tray element when said tray element is placed on the luggage, said tray element further including a projecting portion bearing oppositely extending walls integral therewith, which projecting portion is adapted to slip between the parallel dependent bars of the adjustable handle, said projecting portion including an erect member which extends perpendicularly from the top surface of the tray element, and which slides to the back side of the adjustable handle, whereupon, when the adjustable handle is urged downwardly against the flat surface of the tray element to secure the tray element into a position for use as a table, the erect member engages the back side of the adjustable handle to hold the tray element in place in a substantially horizontal position on the luggage.

5. A laptop computer support system which includes a tray element which, in combination with a piece of luggage forms a support member for a laptop computer, wherein the luggage has a handle and the handle includes front and back sides as well as parallel dependent bars thereon which are arranged to be connected to the top wall of said piece of luggage, said tray element comprising:

a substantially planar top surface having an area adequate to accommodate and support a bottom surface of a laptop computer, said top surface of said tray element including a ridge adapted to retain the computer from sliding off the tray element when said tray element is placed on the luggage, said tray element further including a projecting portion bearing oppositely extending walls integral with said tray element, which projecting portion is adapted to slip between the parallel dependent bars of the handle, said projecting portion including an erect member which extends perpendicularly from the top surface of the tray element, and which slides to the back side of the handle, whereupon, the computer tray element can be secured into a position for use as a computer support by engagement of the erect member against the back side of the handle to hold the tray element in place in a substantially horizontal position on the luggage.

6. A laptop computer support system as claimed in claim 5, wherein the erect member consists of a pivotally mounted leaf member and a recess arranged to receive the pivotally disposed leaf member so that the leaf member can be pivoted between a position within the recess and an erect position for insertion between said parallel dependent bars.

7. A laptop computer support system as claimed in claim 6, which further includes providing said pivotally disposed leaf member with laterally off-standing trunnion members adjacent to opposite edge portions thereof, said trunnion members arranged to be received in said slots in opposed wall areas of said recess in said portion which projects from said flat surface area.

8. A laptop computer support system as claimed in claim 7, wherein said leaf member is designed so as to be movable from a non-functional position from said planar surface into a right angular erect position when positioned beneath said adjustable handle.

* * * * *